US009327539B2

(12) United States Patent
Hsu

(10) Patent No.: US 9,327,539 B2
(45) Date of Patent: May 3, 2016

(54) DYE-SUBLIMATION PRINTING METHOD FOR LIGHT TRANSMISSIVE MEDIUM AND PRODUCT MADE BY THE SAME

(71) Applicant: HITI DIGITAL, INC., New Taipei (TW)

(72) Inventor: Shiu-Sheng Hsu, New Taipei (TW)

(73) Assignee: HiTi Digital, Inc., New Taipei (TW)

( * ) Notice: Subject to any disclaimer, the term of this patent is extended or adjusted under 35 U.S.C. 154(b) by 0 days.

(21) Appl. No.: 14/550,860

(22) Filed: Nov. 21, 2014

(65) Prior Publication Data

US 2015/0258832 A1 Sep. 17, 2015

Related U.S. Application Data

(60) Provisional application No. 61/953,941, filed on Mar. 17, 2014.

(30) Foreign Application Priority Data

Sep. 11, 2014 (TW) ..... 103131400 A

(51) Int. Cl.
*B41J 33/00* (2006.01)
*B41J 2/315* (2006.01)
*B41M 5/385* (2006.01)

(52) U.S. Cl.
CPC ..... *B41M 5/385* (2013.01)

(58) Field of Classification Search
USPC ..... 347/171–176, 101, 103–106, 214, 215, 347/217, 16; 359/26
See application file for complete search history.

(56) References Cited

U.S. PATENT DOCUMENTS 4,666,320 A 5/1987 Kobayashi et al.
4,783,376 A * 11/1988 Sakaki ..... B41M 5/44 347/105
5,580,410 A 12/1996 Johnston
5,856,048 A * 1/1999 Tahara ..... B41M 3/14 359/26
7,018,772 B2 3/2006 Simpson et al.
2007/0115341 A1* 5/2007 Isaac ..... B41J 17/36 347/171
2012/0194884 A1 8/2012 Shinoda et al.

FOREIGN PATENT DOCUMENTS

JP 2011167931 A 9/2011

OTHER PUBLICATIONS

Office Action for corresponding Japanese Patent Application No. 2014-245024, 3 pp., (Nov. 17, 2015).
Office Action for corresponding Taiwanese Patent Application No. 103131400, 5 pp., (Sep. 7, 2015).

* cited by examiner

*Primary Examiner* — Kristal Feggins
(74) *Attorney, Agent, or Firm* — Blakely Sokoloff Taylor & Zafman LLP

(57) ABSTRACT

A dye sublimation printing method for a light transmissive medium includes the following steps. First, a ribbon is provided above the light transmissive medium. Then, the light transmissive medium is moved. During the period that the light transmissive medium is moved, at least one first dye zone of the ribbon is heated, so that the dye in the first dye zone is transferred onto the light transmissive medium.

6 Claims, 6 Drawing Sheets

DYE-SUBLIMATION PRINTING METHOD FOR LIGHT TRANSMISSIVE MEDIUM AND PRODUCT MADE BY THE SAME

RELATED APPLICATIONS

This application claims priority to U.S. Provisional Application Ser. No. 61/953,941, filed Mar. 17, 2014, the entirety of which is herein incorporated by reference. This application also claims priority to Taiwan Application Serial Number 103131400, filed Sep. 11, 2014, the entirety of which is herein incorporated by reference.

BACKGROUND

1. Technical Field

Embodiments of the present disclosure relate to a dye-sublimation printing technique. More particularly, embodiments of the present disclosure relate to a dye-sublimation printing method and a product made by the same.

2. Description of Related Art

Dye-sublimation printer has an excellent printing ability, such as printing a full-tone colored pattern, and therefore is widely used. The dye-sublimation printer employs a thermal printing head (TPH) to heat a ribbon, so as to change the phase of the dye into gaseous state. The heated dye of gaseous state diffuses onto a white card and solidifies to form a pattern. In the control of the heating time or the heating temperature, the dye-sublimation printer forms the full-tone colored pattern.

Particularly, the ribbon has a plurality of dye panels. These dye panels respectively have different colored dyes. The dye-sublimation printer employs transporting mechanism, such as rollers, to transport the white card forward to the position under the thermal printing head. The dye-sublimation printer transfers one colored dye in a single dye panel onto the white card at a time by heating the ribbon. After the colored dye is transferred onto the white card, the transporting mechanism moves the white card back to the original position, so as to conduct the transfer of another colored dye in another dye panel.

However, a viewer can only see the pattern on the medium from the printed side of the medium, rather than from the non-printed side.

SUMMARY

It is to be understood that both the foregoing general description and the following detailed description are by examples, and are intended to provide further explanation of the invention as claimed.

Embodiments of the present disclosure provide a dye-sublimation printing technique, and the product made by this technique allows the viewer to see the printed pattern from the location under the non-printed surface of the printed medium.

In accordance with one embodiment of the present disclosure, a dye-sublimation method for a light transmissive medium includes following steps. First of all, a ribbon is provided above the light transmissive medium. Then, the light transmissive medium is moved. During the period of moving the light transmissive medium, at least one first dye panel of the ribbon is heated, so as to transfer a first dye in the first dye panel onto the light transmissive medium.

In accordance with another embodiment of the present disclosure, a dye-sublimation printed product includes a light transmissive medium and at least one first dye layer. The light transmissive medium has a printed surface and a non-printed surface opposite to each other. The first dye layer is transferred onto the printed surface of the light transmissive medium. A thickness of the light transmissive medium is greater than a thickness of the first dye layer.

In the foregoing embodiments, because the first dye layer is transferred onto the light transmissive medium, not a white card, the viewer can see the pattern formed by first dye layer from the location under the non-printed surface of the light transmissive medium.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
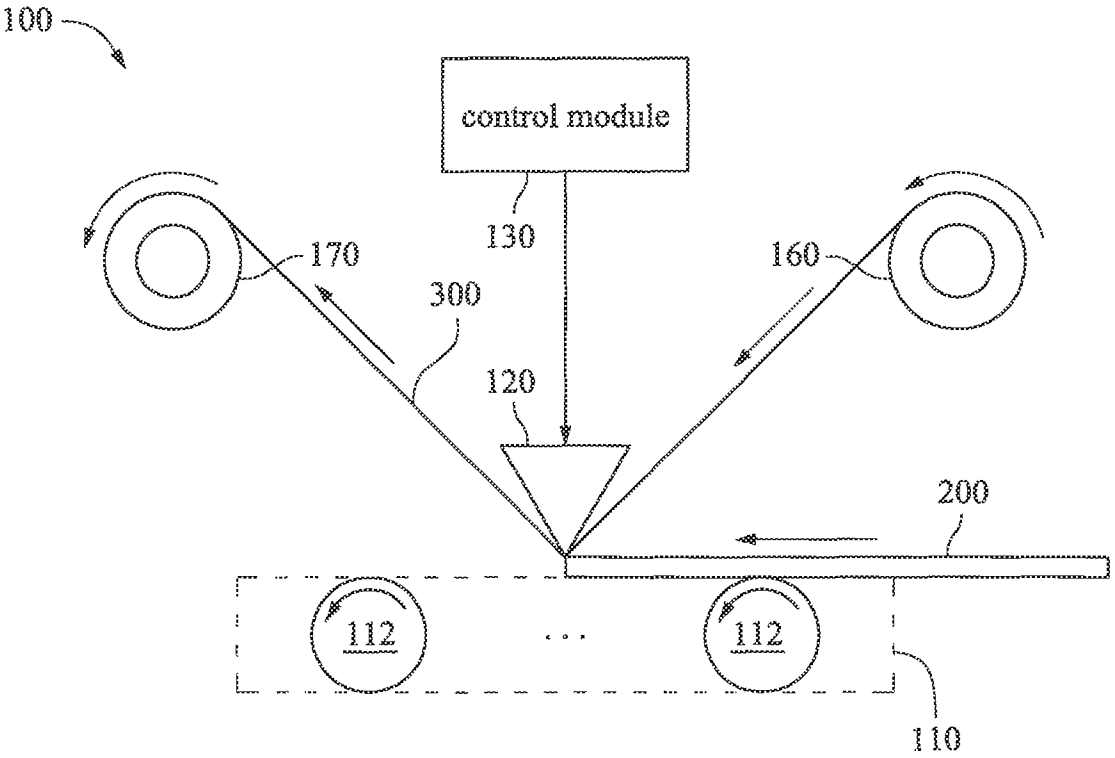
FIG. 1 is a schematic view of a printer in accordance with one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

FIG. 1 is a schematic view of a printer 100 in accordance with one embodiment of the present disclosure. As shown in FIG. 1, the printer 100 includes a medium actuator 110, a thermal printing head 120, a control module 130, a ribbon supply device 180 and a ribbon take-up device 170. In this embodiment, the medium actuator 110 includes a plurality of rollers 112. A light transmissive medium 200 is placed on the rollers 112. When the roller 112 rolls, it can move the light transmissive medium 200. In some embodiments, the medium actuator 110 may employ other transporting devices to replace the roller 112. In some embodiments, the medium actuator 110 further includes an auxiliary roller or a bearing roller (not shown) to further make the light transmissive medium 200 move steadily.

The ribbon supply device 160 and the ribbon take-up device 170 cooperate to transport a ribbon 300, so as to move to the ribbon 300 to the location above the light transmissive medium 200. For example, the ribbon supply device 160 and the ribbon take-up device 170 can be, but are not limited to be, rollers for moving the ribbon 300 in a roll-to-roll manner, The thermal printing head 120 is located above the light transmissive medium 200 and is located on the moving path of the ribbon 300. The control module 130 is electrically connected to the thermal printing head 120, so as to control the thermal printing head 120 to heat the ribbon 300 having dyes, thereby transferring the dyes on the ribbon 300 to the light transmissive medium 200 for forming a pattern.

By the foregoing embodiments, because the dye on the ribbon 300 is transferred onto the light transmissive medium 200, not a white card, the viewer can see the pattern formed by the dye from the location under the non-printed surface of the light transmissive medium 200.

Figure 2:
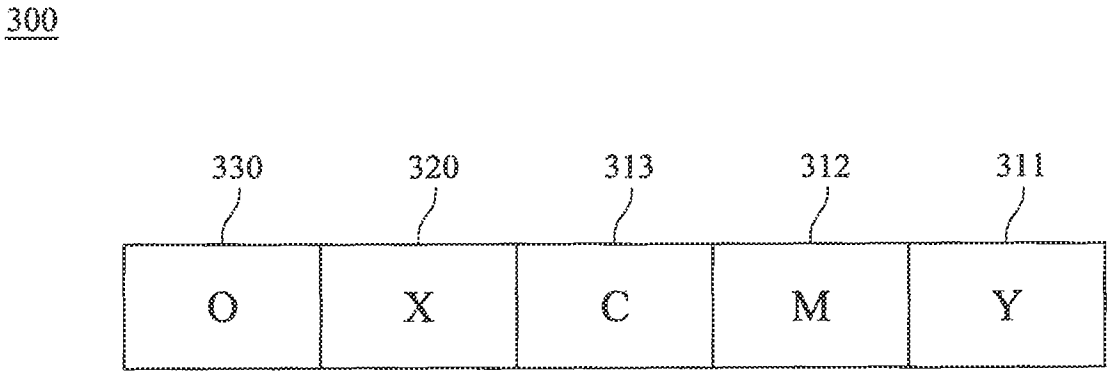
FIG. 2 is a top view of the ribbon shown in FIG. 1.

In some embodiments, the ribbon 300 has a plurality of first dye panels arranged in order, and these first dye panels respectively have first dyes in different colors, which allow formation of the colored pattern. For example, reference can be now made to FIG. 2, which is a top view of the ribbon 300 shown FIG. 1. As shown in FIG. 2, the ribbon 300 includes first dye panels 311, 312 and 313, a background dye panel 320 and an overcoat material panel 330 arranged in order. The first dye panels 311, 312 and 313 respectively include dyes in different colors. For example, the first dye panel 311 may include the yellow dye, and the first dye panel 312 may include the magenta dye, and the first dye panel 313 may include the cyan dye. When the foregoing dyes are transferred onto the light transmissive medium 200, they are mixed and form a first colored pattern.

The background dye panel 320 may include a background dye. A color of the background dye is different from the color of the foregoing first dyes, so as to be the background of the first colored pattern. For example, the background dye panel 320 may include a white dye, a black dye and so on. The overcoat material panel 330 may include an overcoat material to protect the dyes listed above.

As shown in FIGS. 1 and 2, when the ribbon supply device 160 and the ribbon take-up device 170 transport the ribbon 300, the first dye panels 311, 312 and 313, the background dye panel 320 and the overcoat material panel 330 are sequentially transported toward the thermal printing head 120. When the first dye panel 311 is transported to the location under the thermal printing head 120, the medium actuator 110 moves the light transmissive medium 200. During the period of moving the light transmissive medium 200, the thermal printing head 120 heats the first dye in the first dye panel 311, so as to transfer the first dye in the first dye panel 311, such as the yellow dye, onto the light transmissive medium 200. When the process of transferring the yellow dye is completed, the medium actuator 110 moves the light transmissive medium 200 back to the original position. In some embodiments, the light transmissive medium 200 can be coated with a dye receiving layer, which facilitates the transfer process of which the first dye is transferred onto the light transmissive medium 200.

Then, the ribbon supply device 160 and the ribbon take-up device 170 transport the ribbon 300 to make the first dye panel 312 transported to the location under the thermal printing head 120. Then, the medium actuator 110 moves the light transmissive medium 200. During the period of moving the light transmissive medium 200, the thermal printing head 120 heats the first dye in the first dye panel 312, so as to transfer the first dye in the first dye panel 312, such as the magenta dye, onto the light transmissive medium 200. When the process of transferring the magenta dye is completed, the medium actuator 110 moves the light transmissive medium 200 back to the original position.

Then, the ribbon supply device 160 and the ribbon take-up device 170 transport the ribbon 300 to make the first dye panel 313 transported to the location under the thermal printing head 120. Then, the medium actuator 110 moves the light transmissive medium 200. During the period of moving the light transmissive medium 200, the thermal printing head 120 heats the first dye in the first dye panel 313, so as to transfer the first dye in the first dye panel 313, such as the cyan dye, onto the light transmissive medium 200. When the process of transferring the cyan dye is completed, the medium actuator 110 moves the light transmissive medium 200 back to the original position.

Then, the ribbon supply device 160 and the ribbon retrieving device 170 transport the ribbon 300 to make the background dye panel 320 transported to the location under the thermal printing head 120. Then, the medium actuator 110 moves the light transmissive medium 200. During the period of moving the light transmissive medium 200, the thermal printing head 120 heats the background dye in the background dye panel 320, so as to transfer the background dye in the background dye panel 320, such as a silver dye, a golden dye, a white dye, a black dye, a brown dye and so on, onto the light transmissive medium 200, the first dye and both of them. When the process of transferring the background dye is completed, the medium actuator 110 moves the light transmissive medium 200 back to the original position.

Then, the ribbon supply device 160 and the ribbon take-up device 170 transport the ribbon 300 to make the overcoat material panel 330 transported to the location under the thermal printing head 120. Then, the medium actuator 110 moves the light transmissive medium 200. During the period of moving the light transmissive medium 200, the thermal printing head 120 heats the overcoat material in the overcoat material panel 330, so as to transfer the overcoat material in the overcoat material panel 330 onto the background material on the light transmissive medium 200. When the process of transferring the overcoat material is completed, the medium actuator 110 moves the light transmissive medium 200 back to the original position.

Figure 3:
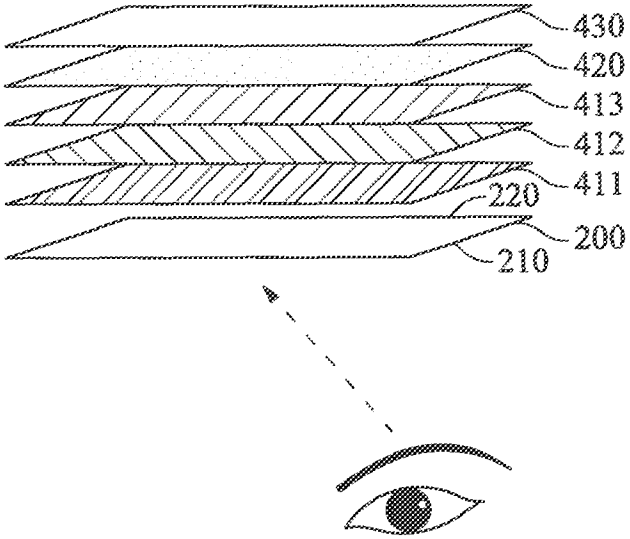
FIG. 3 is a schematic view of the dye-sublimation printed product viewing from the location under the non-printed surface of the light transmissive medium.

The dye-sublimation printed product made by the forgoing method can be referred to FIG. 3, in which FIG. 3 is a schematic view of the dye-sublimation printed product viewing from the location under the non-printed surface 210 of the light transmissive medium 200. As shown in FIG. 3, the dye-sublimation printed product includes the light transmissive medium 200, a plurality of first dye layers 411, 412 and 413, a background dye layer 420 and an overcoat layer 430. The light transmissive medium 200 includes a non-printed surface 210 and a printed surface 220 opposite to each other. The first dye layer 411 is directly stacked on the printed surface 220 of the light transmissive medium 200 by transferring the first dye in the first dye panel 311, and therefore, the first dye layer 411 includes the first dye therein, such as the yellow dye. The first dye layer 412 is directly stacked on the first dye layer 411 by transferring the first dye in the first dye panel 312, and therefore, the first dye layer 412 includes the first dye therein, such as the magenta dye. The first dye layer 413 is directly stacked on the first dye layer 412 by transferring the first dye in the first dye panel 313, and therefore, the first dye layer 413 includes the first dye therein, such as the cyan dye. As a result, the first dye layers 411, 412 and 413 respectively include dyes in colors different from each other, so as to form the colored first pattern. The background dye layer 420 is directly stacked on the first dye layer 413 by transferring the background dye in the background dye panel 320. The background dye is in the color different from yellow, magenta and cyan. For example, the background dye may be, but is not limited to be, the silver dye, the golden dye, the white dye, the black dye, or the brown dye. The overcoat layer 430 is directly stacked on the background dye layer 420 by transferring the overcoat material in the overcoat material panel 330. The overcoat layer 430 includes the overcoat material therein, so as to prevent the background dye, the first dye or both of them from damaged due to an external forces, such as scratched by a nail.

Although the first dye layers 411, 412 and 413 is disposed on the printed surface 220 of the light transmissive medium 200, the viewer can see the first pattern formed by the first dye layers 411, 412, and 413 from the location under the non-printed surface 210 of the light transmissive medium 200 as well. Moreover, because the viewer can see the background dye layer 420 from the location under the non-printed surface 210 of the light transmissive medium 200, the background dye in the background layer 420 can be the background of the first colored pattern formed by the first dye layers 411, 412 and 413.

Further, the overcoat layer 430 can protect the background dye layer 420, so as to prevent a portion of the background dye in the background dye layer 420 from damaged due to the external force. The light transmissive medium 200 can protect the first dye layers 411, 412 and 413, so as to prevent portions of the first dye layers 411, 412 and 413 from damaged due to the external force. In such a configuration, the first dyes and the background dye can be sandwiched between the light transmissive medium 200 and the overcoat layer 430, thereby being protected by the light transmissive medium 200 and the overcoat layer 430.

In some embodiments, the first dye layers 411, 412 and 413 cover a part of the printed surface 220 of the light transmissive medium 200, and a part of the printed surface 220 is exposed. In this embodiment, the background dye layer 420 can not only be transferred onto the first dye of the first dye layer 413, but can also be transferred onto the printed surface 220 of the light transmissive medium 200, so as to visually perform a background of the first colored pattern formed by the first dye layers 411, 412 and 413.

In some embodiments, when the first dye layers 411, 412 and 413 partially cover the printed surface 220 of the light transmissive medium 200, and a part of the printed surface 220 is exposed, the background dye layer 420 can be only transferred onto the exposed part of the printed surface 220 without being transferred onto the first dye layer 413. In such a way, the background dye in the background dye layer 420 can visually perform the background of the first colored pattern formed by the first dye layers 411, 412 and 413 as well.

In some embodiments, a thickness of the light transmissive medium 200 is greater than a summation of a total thickness of the first dye layers 411, 412 and 413, so as to steadily support the first dye layers 411, 412 and 413. In some embodiments, the light transmissive medium 200 has a transparent material, which allows the viewer to see the first colored pattern formed by the first dye layers 411, 412 and 413 from the location under the non-printed surface 210.

Figure 4:
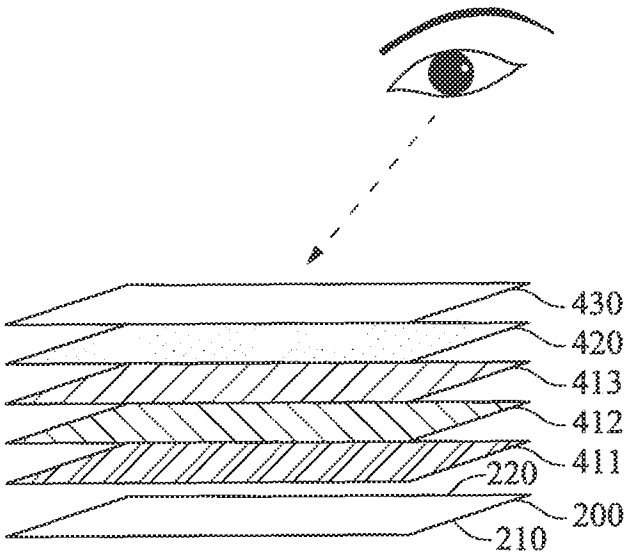
FIG. 4 is another schematic view of the dye-sublimation printed product shown in FIG. 3. viewing from the location above the printed surface of the light transmissive medium.

FIG. 4 is another schematic view of the dye-sublimation printed product shown in FIG. 3. viewing from the location above the printed surface 220 of the light transmissive medium 200. As shown in FIG. 4, the viewer sees the overcoat layer 430 and the background dye layer 420 from the location above the printed surface 220. In some embodiments, the overcoat layer 430 is light transmissive, so as to allow the viewer to see the color of the background dye from the location above the printed surface 220. In some embodiments, the background dye layer 420 includes patterns, such as heart-shaped patterns, circle patterns or diamond-shaped patterns. The viewer sees the foregoing patterns through the overcoat layer 430 from the location above the printed surface 220.

For example, as shown in FIGS. 1 and 2, the background dye panel 320 of the ribbon 300 includes a red dye therein. The thermal printing head 120 heats the background dye in the background dye panel 320 toward at least one heart-shaped zone of the first dye layer 413 (See FIG. 3), so as to transfer the red dye onto the first dye layer 413. As such, the background dye layer 420 has at least one red heart-shaped pattern thereon.

As shown in FIGS. 3 and 4, the viewer not only sees the first colored pattern formed by the first dye layers 411, 412 and 413 from the location under the non-printed surface 210, but also sees the pattern in the background dye layer 420 from the location above the printed surface 220.

Figure 5:
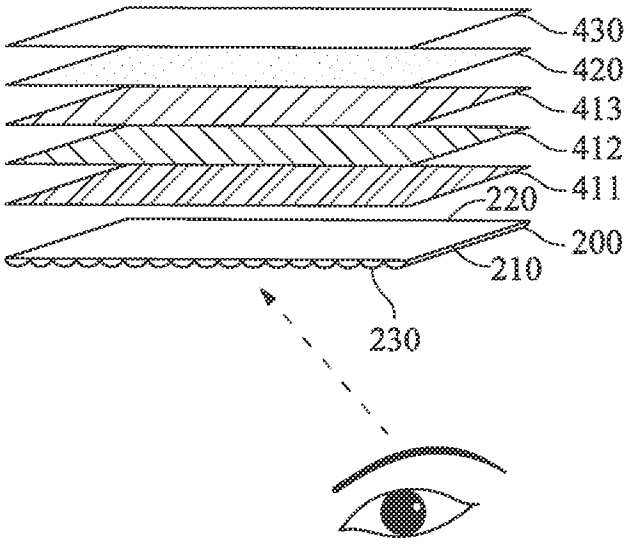
FIG. 5 is a schematic view of the dye-sublimation printed product in accordance with another embodiment of the present disclosure.

FIG. 5 is a schematic view of the dye-sublimation printed product in accordance with another embodiment of the present disclosure. As shown in FIG. 5, the main difference between this embodiment and foregoing embodiments is that the light transmissive medium 200 includes gratings 230. The gratings 230 are disposed on the non-printed surface 210 of the light transmissive medium 200. As such, the viewer can see a 3D pattern formed by the first dye layers 411, 412 and 413 through the gratings 230 from a location under the non-printed surface 210. In some embodiments, the gratings 230 and the non-printed surface 210 of the light transmissive medium 200 are integrally formed.

Figure 6:
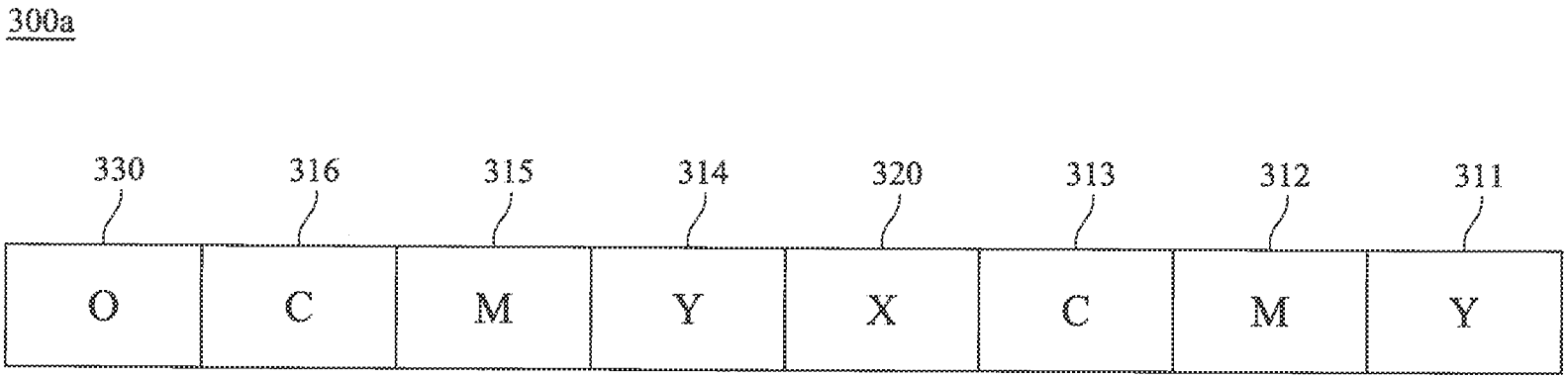
FIG. 6 is a top view of the ribbon in accordance with another embodiment of the present disclosure.

FIG. 6 is a top view of the ribbon 300*a* in accordance with another embodiment of the present disclosure. As shown in FIG. 6, the main difference between this embodiment and foregoing embodiments is that the ribbon 300*a* further includes a plurality of second dye panels 314, 315 and 316. The second dye panels 314, 315 and 316 are disposed between the background dye panel 320 and the overcoat material panel 330. Further, the first dye panels 311, 312 and 313, the background dye panel 320, the second dye panels 314, 315 and 316 and the overcoat panel 330 are arranged in order. The second dye panels 314, 315 and 316 may include second dyes in different colors. For example, the second dye panel 314 may include the yellow dye, and the second dye panel 315 may include the magenta dye, and the second dye panel 316 may include the cyan dye.

The color of the background dye is different from the color of the second dye, so that the background dye can be the background of the second colored pattern formed by the second dyes. For example, the background dye panel 320 includes a white dye, a black dye, a brown dye and so on.

As shown in FIGS. 1 and 6, when the ribbon supply device 160 and the ribbon take-up device 170 transport the ribbon 300*a*, the first dye panels 311, 312 and 313, the background dye panel 320, the second dye panels 314, 315 and 316, and the overcoat material panel 330 are sequentially transported toward the thermal printing head 120. When the first dye panel 311 is transported to the location under the thermal printing head 120, the medium actuator 110 moves the light transmissive medium 200. During the period of moving the light transmissive medium 200, the thermal printing head 120 heats the first dye in the first dye panel 311, so as to transfer the first dye in the first dye panel 311, such as the yellow dye, onto the light transmissive medium 200. When the process of transferring the yellow dye is completed, the medium actuator 110 moves the light transmissive medium 200 back to the original position. In some embodiments, the light transmissive medium 200 can be coated with a dye receiving layer, which facilitates the transfer process of which the first dye is transferred onto the light transmissive medium 200.

Then, the ribbon supply device 160 and the ribbon take-up device 170 transport the ribbon 300*a* to make the first dye panel 312 transported to the location under the thermal printing head 120. Then, the medium actuator 110 moves the light transmissive medium 200. During the period of moving the light transmissive medium 200, the thermal printing head 120 heats the first dye in the first dye panel 312, so as to transfer the first dye in the first dye panel 312, such as the magenta dye, onto the light transmissive medium 200. When the process of transferring the magenta dye is completed, the medium actuator 110 moves the light transmissive medium 200 back to the original position.

Then, the ribbon supply device 160 and the ribbon take-up device 170 transport the ribbon 300*a* to make the first dye panel 313 transported to the location under the thermal printing head 120. Then, the medium actuator 110 moves the light transmissive medium 200. During the period of moving the light transmissive medium 200, the thermal printing head 120 heats the first dye in the first dye panel 313, so as to transfer the first dye in the first dye panel 313, such as the cyan dye, onto the light transmissive medium 200. When the process of transferring the cyan dye is completed, the medium actuator 110 moves the light transmissive medium 200 back to the original position.

Then, the ribbon supply device 160 and the ribbon take-up device 170 transport the ribbon 300*a* to make the background dye panel 320 transported to the location under the thermal printing head 120. Then, the medium actuator 110 moves the light transmissive medium 200. During the period of moving the light transmissive medium 200, the thermal printing head 120 heats the background dye in the background dye panel 320, so as to transfer the background dye in the background dye panel 320, such as a silver dye, a golden dye, a white dye, a black dye, a brown dye and so on, onto the light transmissive medium 200, the first dye and both of them. When the process of transferring the background dye is completed, the medium actuator 110 moves the light transmissive medium 200 back to the original position.

Then, the ribbon supply device 160 and the ribbon take-up device 170 transport the ribbon 300*a* to make the second dye panel 314 transported to the location under the thermal printing head 120. Then, the medium actuator 110 moves the light transmissive medium 200. During the period of moving the light transmissive medium 200, the thermal printing head 120 heats the second dye in the second dye panel 314, so as to transfer the second dye in the second dye panel 314, such as a yellow dye, onto the background dye on the light transmissive medium 200. When the process of transferring the yellow dye is completed, the medium actuator 110 moves the light transmissive medium 200 back to the original position.

Then, the ribbon supply device 160 and the ribbon take-up device 170 transport the ribbon 300*a* to make the second dye panel 315 transported to the location under the thermal printing head 120. Then, the medium actuator 110 moves the light transmissive medium 200. During the period of moving the light transmissive medium 200, the thermal printing head 120 heats the second dye in the second dye panel 315, so as to transfer the second dye in the second dye panel 315, such as a magenta dye, onto the background dye on the light transmissive medium 200. When the process of transferring the magenta dye is completed, the medium actuator 110 moves the light transmissive medium 200 back to the original position.

Then, the ribbon supply device 160 and the ribbon take-up device 170 transport the ribbon 300*a* to make the second dye panel 316 transported to the location under the thermal printing head 120. Then, the medium actuator 110 moves the light transmissive medium 200. During the period of moving the light transmissive medium 200, the thermal printing head 120 heats the second dye in the second dye panel 316, so as to transfer the second dye in the second dye panel 316, such as a cyan dye, onto the background dye on the light transmissive medium 200. When the process of transferring the cyan dye is completed, the medium actuator 110 moves the light transmissive medium 200 back to the original position.

Then, the ribbon supply device 160 and the ribbon take-up device 170 transport the ribbon 300*a* to make the overcoat material panel 330 transported to the location under the thermal printing head 120. Then, the medium actuator 110 moves the light transmissive medium 200. During the period of moving the light transmissive medium 200, the thermal printing head 120 heats the overcoat material in the overcoat material panel 330, so as to transfer the overcoat material in the overcoat material panel 330 onto the second dye, the background dye on the light transmissive medium 200 or both of them. When the process of transferring the overcoat material is completed, the medium actuator 110 moves the light transmissive medium 200 back to the original position.

Figure 7:
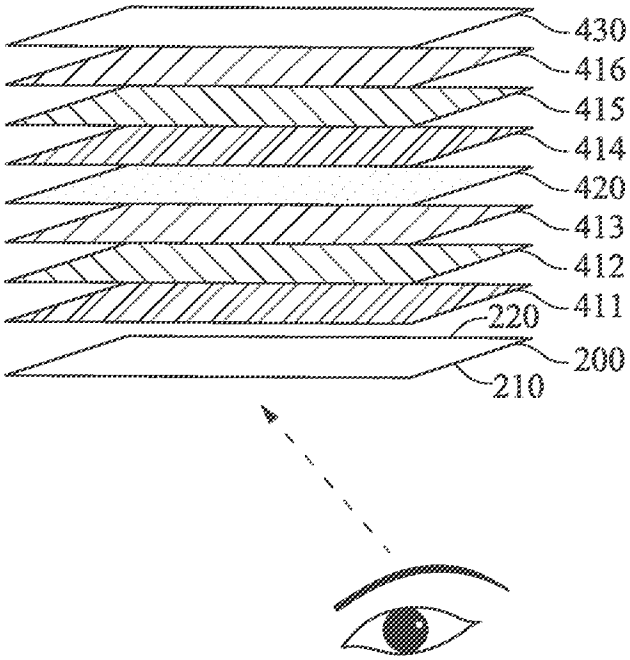
FIG. 7 is a schematic view of the dye-sublimation printed product viewing from the location under the non-printed surface of the light transmissive medium.

The dye-sublimation printed product made by the forgoing method can be referred to FIG. 7, in which FIG. 7 is a schematic view of the dye-sublimation printed product viewing from the location under the non-printed surface 210 of the light transmissive medium 200. As shown in FIG. 7, the dye-sublimation printed product includes the light transmissive medium 200, a plurality of first dye layers 411, 412 and 413 in different colors, a background dye layer 420, a plurality of second dye layers 414, 415 and 416 and an overcoat layer 430. The first dye layer 411 is directly stacked on the printed surface 220 of the light transmissive medium 200 by transferring the first dye in the first dye panel 311, and therefore, the first dye layer 411 includes the first dye therein, such as the yellow dye. The first dye layer 412 is directly stacked on the first dye layer 411 by transferring the first dye in the first dye panel 312, and therefore, the first dye layer 412 includes the first dye therein, such as the magenta dye. The first dye layer 413 is directly stacked on the first dye layer 412 by transferring the first dye in the first dye panel 313, and therefore, the first dye layer 413 includes the first dye therein, such as the cyan dye. As a result, the first dye layers 411, 412 and 413 respectively include dyes in colors different from each other, so as to form the colored first pattern. The background dye layer 420 is directly stacked on the first dye layer 413 by transferring the background dye in the background dye panel 320. The background dye is in the color different from yellow, magenta and cyan. For example, the background dye may be, but is not limited to be, the white dye, the black dye, or the brown dye.

The second dye layer 414 is directly stacked on the background dye layer 420 by transferring the second dye in the second dye panel 314, and therefore, the second dye layer 414 includes the second dye therein, such as the yellow dye. The second dye layer 415 is directly stacked on the second dye layer 414 by transferring the second dye in the second dye panel 315, and therefore, the second dye layer 415 includes the second dye therein, such as the magenta dye. The second dye layer 416 is directly stacked on the second dye layer 415 by transferring the second dye in the second dye panel 316, and therefore, the second dye layer 416 includes the second dye therein, such as the cyan dye. The overcoat layer 430 is directly stacked on the second dye layer 416, the background dye layer 420 or both of them by transferring the overcoat material in the overcoat material panel 330. The overcoat layer 430 includes the overcoat material therein, so as to prevent the background dye, the first dye, the second dye or any combination of them from damaged due to an external forces, such as scratched by a nail.

Figure 8:
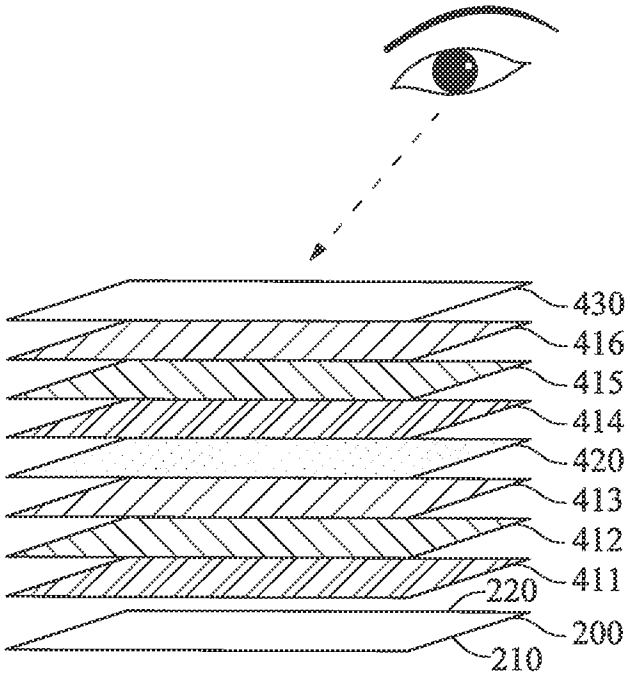
FIG. 8 is a schematic view of the dye-sublimation printed product viewing from the location above the printed surface of the light transmissive medium.

As a result, as shown in FIGS. 7 and 8, the viewer not only sees the pattern formed by the first dye layers 411, 412 and 413 from the location under the non-printed surface 210, but also sees the pattern formed by the second dye layers 414, 415 and 416 from the location above the printed surface 220. Therefore, the dye-sublimation printed product can show double-sided printing patterns by printing on a single printed surface 220 of the light transmissive medium 200.

In some embodiments, the light transmissive medium 200 can be, but is limited to be, a light transmissive card or a light transmissive paper. As long as a light transmissive material can be attached by dyes, this light transmissive material satisfies the "light transmissive medium" in the context.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A dye-sublimation printing method for a light transmissive medium comprising:

providing a ribbon above the light transmissive medium;

moving the light transmissive medium;

heating at least one first dye panel of the ribbon during the period of moving the light transmissive medium, so as to transfer a first dye in the first dye panel onto the light transmissive medium; and heating at least one background dye panel to transfer a background dye in the background dye panel onto the first dye, the light transmissive medium or both of them after transferring the first dye, wherein a color of the background dye is different from a color of the first dye.

2. The dye-sublimation printing method of claim 1, further comprising:

heating at least one overcoat material panel to transfer an overcoat material in the overcoat material panel onto the background dye after transferring the background dye.

3. The dye-sublimation printing method of claim 1, further comprising:

heating at least one second dye panel of the ribbon to transfer a second dye in the second dye panel onto the background dye after transferring the background dye, wherein the color of the background dye is different from a color of the second dye.

4. The dye-sublimation printing method of claim 3, further comprising:

heating at least one overcoat material panel of the ribbon to transfer an overcoat material in the overcoat material panel onto the second dye, the background dye or both of them after transferring the second dye.

5. A dye-sublimation printed product, comprising:

a light transmissive medium having a printed surface and a non-printed surface opposite to each other;

at least one first dye layer transferred onto the printed surface of the light transmissive medium, wherein a thickness of the light transmissive medium is greater than a thickness of the first dye layer;

a background dye layer transferred onto the first dye layer, the light transmissive medium or both of them, wherein a color of a background dye in the background dye layer is different from a first dye in the first dye layer; and an overcoat layer transferred onto the background dye layer.

6. The dye-sublimation printed product of claim 5, wherein the light transmissive medium comprises gratings disposed on the non-printed surface of the light transmissive medium.

* * * * *